US010022033B1

(12) United States Patent
Maynard

(10) Patent No.: US 10,022,033 B1
(45) Date of Patent: Jul. 17, 2018

(54) FOOT MOP

(71) Applicant: Bonita Maynard, St Petersburg, FL (US)

(72) Inventor: Bonita Maynard, St Petersburg, FL (US)

( * ) Notice: Subject to any disclaimer, the term of this patent is extended or adjusted under 35 U.S.C. 154(b) by 31 days.

(21) Appl. No.: 15/358,212

(22) Filed: Nov. 22, 2016

(51) Int. Cl.

| | |
|---|---|
| ***A47L 13/282*** | (2006.01) |
| ***A47L 13/22*** | (2006.01) |
| ***A43B 3/12*** | (2006.01) |
| ***A47L 13/17*** | (2006.01) |
| ***A47L 13/28*** | (2006.01) |
| ***A46B 9/02*** | (2006.01) |

(52) U.S. Cl.
CPC ..... *A47L 13/22* (2013.01); *A43B 3/126* (2013.01); *A46B 9/02* (2013.01); *A47L 13/17* (2013.01); *A47L 13/28* (2013.01)

(58) Field of Classification Search
CPC ..... A47L 13/22; A47L 13/17; A47L 13/28; A43B 3/126; A46B 9/02
See application file for complete search history.

(56) References Cited

U.S. PATENT DOCUMENTS

| | | | | |
|---|---|---|---|---|
| 6,052,856 | A | 4/2000 | DeMoya | |
| 6,145,156 | A | 11/2000 | Pullara, Jr. | |
| 2,784,436 | A1 | 8/2002 | Ahern | |
| D573,797 | S | 9/2008 | Guillaume | |
| D641,115 | S | 7/2011 | Walsh | |
| 2,571,606 | A1 | 7/2011 | Scheffler | |
| 2006/0101687 | A1 | 5/2006 | Kane | |
| 2006/0265828 | A1* | 11/2006 | Mallatt | A43B 3/00 15/227 |

FOREIGN PATENT DOCUMENTS

| | | | |
|---|---|---|---|
| CA | 855405 | A | 7/1987 |
| CN | 102078047 | A | 6/2011 |

* cited by examiner

*Primary Examiner* — Shay Karls
(74) *Attorney, Agent, or Firm* — Kyle A. Fletcher, Esq.

(57) ABSTRACT

The foot mop is a cleaning implement that is adapted for use with a foot. The foot mop is adapted for use in cleaning a surface, especially a floor. The foot mop is worn on the foot. The foot mop cleans the surface by using the foot to rub the foot mop against a surface that needs to be cleaned. The foot mop comprises a plurality of bristles. The foot mop is further adapted for use with cleaning products. The foot mop comprises a plurality of shoes.

15 Claims, 4 Drawing Sheets

FOOT MOP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles especially for domestic washing or cleaning, more specifically, an implement for cleaning and disinfecting floors.

SUMMARY OF INVENTION

The foot mop is a cleaning implement that is adapted for use with a foot. The foot mop is adapted for use in cleaning a surface, especially a floor. The foot mop is worn on the foot. The foot mop cleans the surface by using the foot to rub the foot mop against a surface that needs to be cleaned. The foot mop is further adapted for use with one or more cleaning products. In a second potential embodiment of the disclosure, the foot mop is adapted to be worn over the top of a shoe.

These together with additional objects, features and advantages of the foot mop will be readily apparent to those of ordinary skill in the art upon reading the following detailed description of the presently preferred, but nonetheless illustrative, embodiments when taken in conjunction with the accompanying drawings.

In this respect, before explaining the current embodiments of the foot mop in detail, it is to be understood that the foot mop is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the foot mop.

It is therefore important that the claims be regarded as including such equivalent construction insofar as they do not depart from the spirit and scope of the foot mop. It is also to be understood that the phraseology and terminology employed herein are for purposes of description and should not be regarded as limiting.

BRIEF DESCRIPTION OF DRAWINGS

The accompanying drawings, which are included to provide a a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
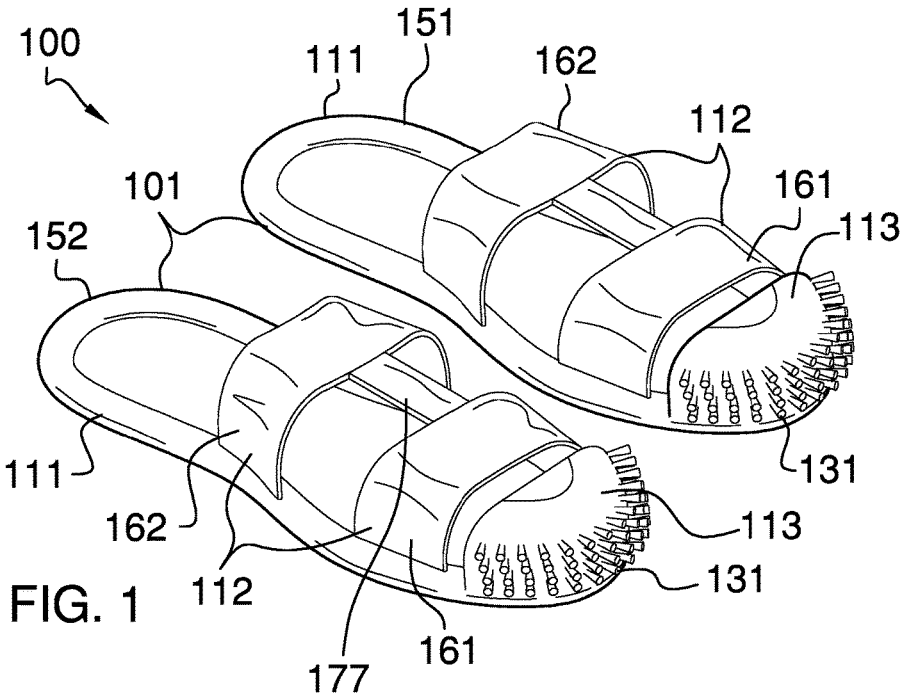
FIG. 1 is a perspective view of an embodiment of the disclosure.
Figure 2:
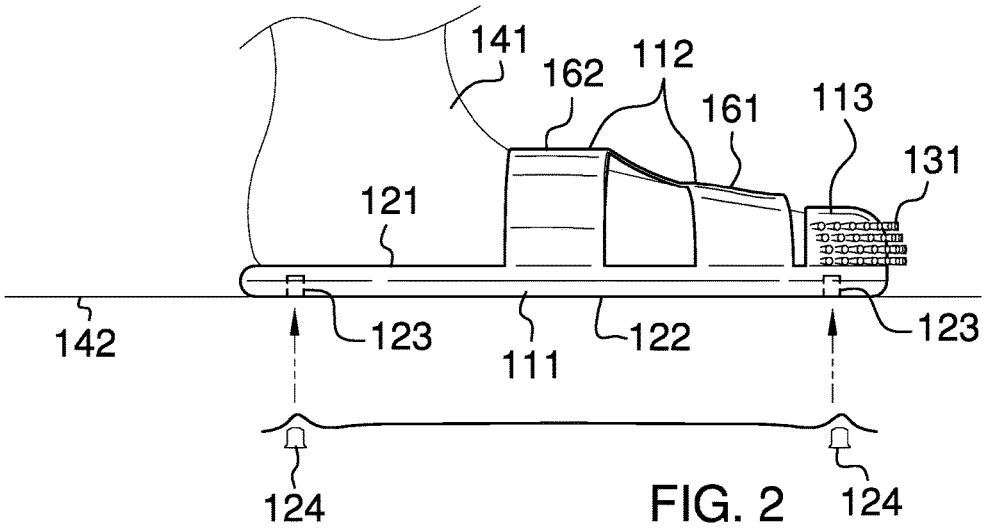
FIG. 2 is a side view of an embodiment of the disclosure.
Figure 3:
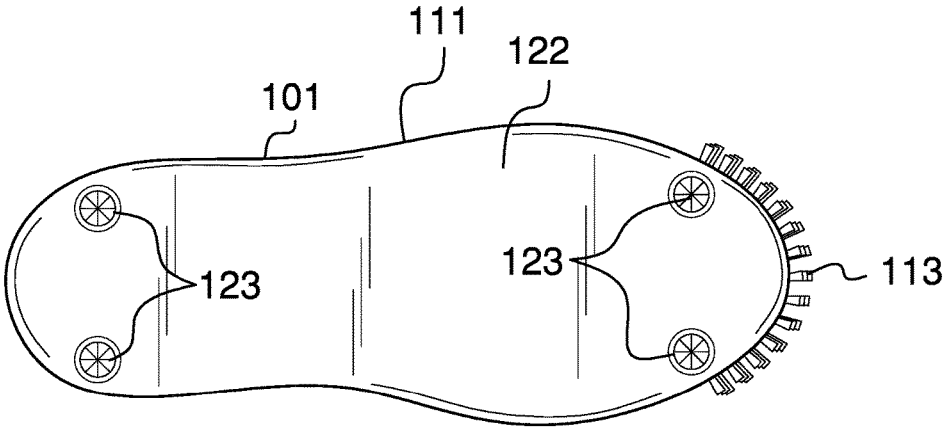
FIG. 3 is a bottom view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The foot mop 100 (hereinafter invention) comprises a plurality of shoes 101. Each of the plurality of shoes 101 is worn on a foot 141 and is rubbed against a target surface 142 to clean the target surface 142. The invention 100 is a cleaning implement that is adapted for use with a foot 141. The invention 100 is adapted for use in cleaning the target surface 142, especially a floor. The invention 100 is worn on the foot 141. The invention 100 cleans the target surface 142 by using the foot 141 to rub the invention 100 against the target surface 142 that needs to be cleaned. The invention 100 is further adapted for use with cleaning products.

Each individual shoe selected from the plurality of shoes 101 comprises a sole 111, an upper, and a toe cap 113. In the first potential embodiment of the disclosure, the upper comprises one or more straps 112. The sole 111 is structure of the individual shoe that is proximal to the target surface 142 being stood on. The one or more upper straps 112 secure the sole 111 to the foot 141. The toe cap 113 is a shell that is attached to sole 111 to form the front upper of the individual shoe. The toe cap 113 is intended to contain the toes of the foot 141 within the interior of the toe cap 113. The individual shoe is worn as a normal shoe during cleaning periods.

Figure 4:
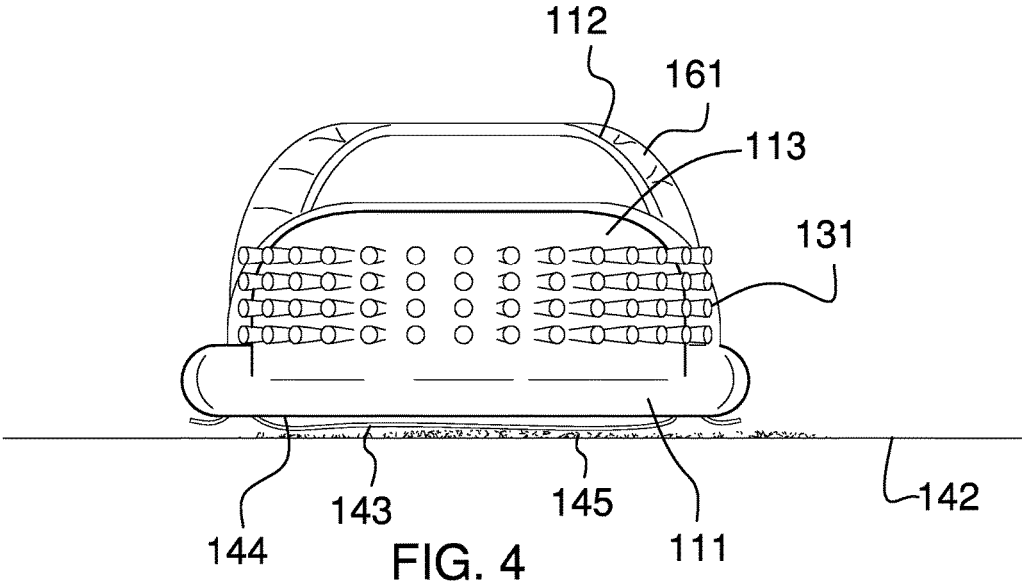
FIG. 4 is a front view of an embodiment of the disclosure.
Figure 5:
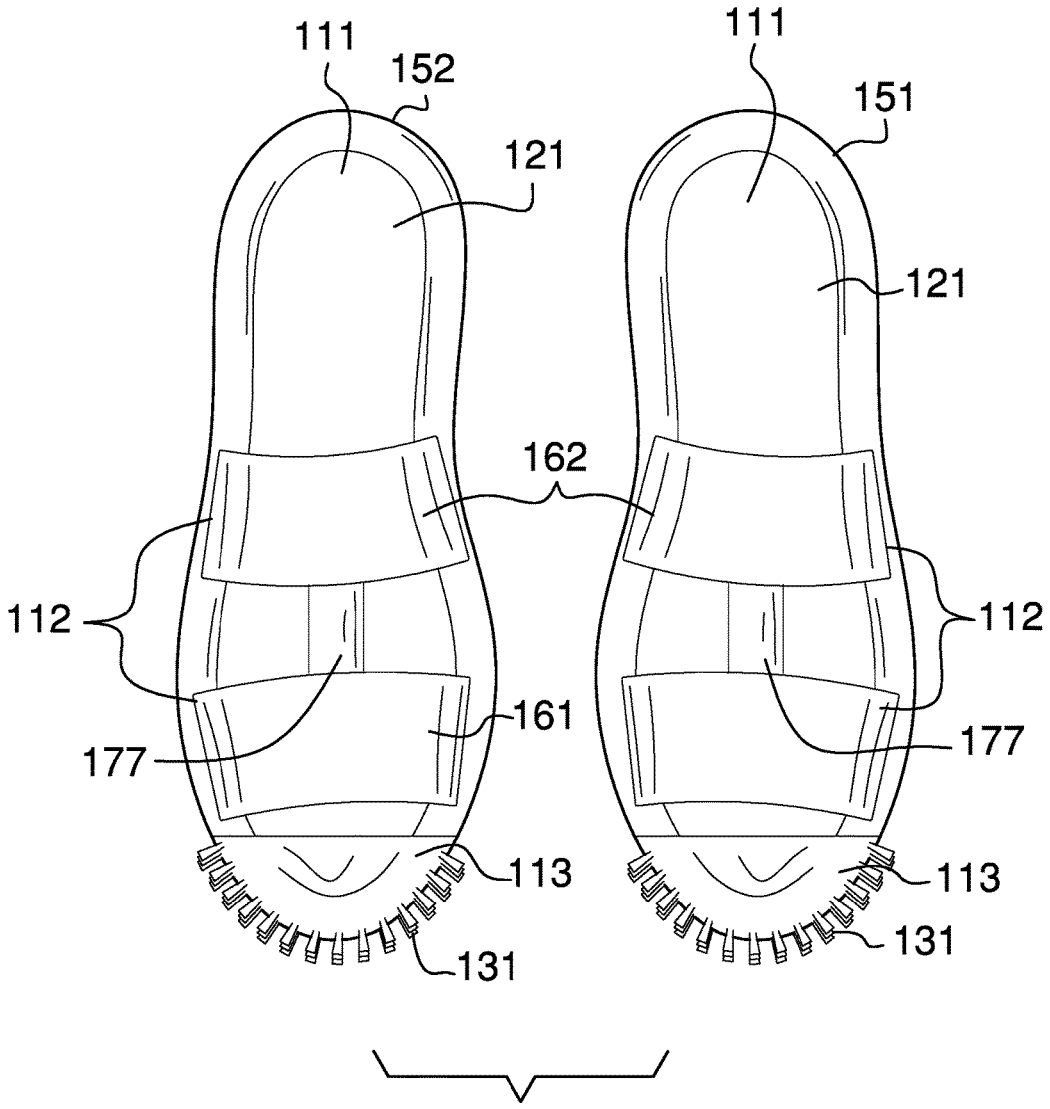
FIG. 5 is a top view of an embodiment of the disclosure.
Figure 6:
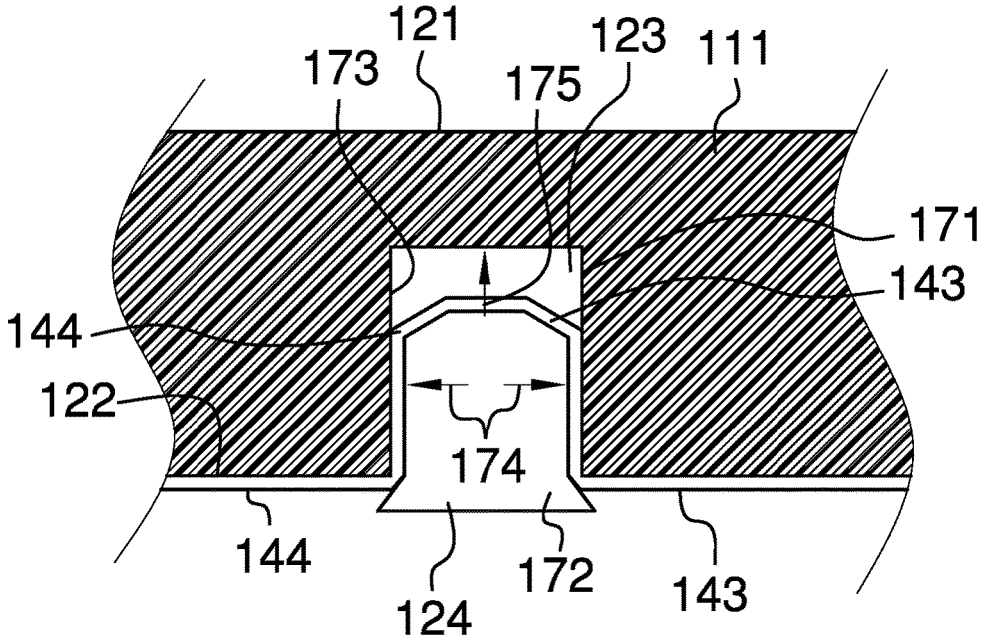
FIG. 6 is a detail view of an embodiment of the disclosure.

As shown most clearly in FIGS. 1 and 4, the exterior of the toe cap 113 further comprises a plurality of bristles 131. The plurality of bristles 131 comprises a collection of semi-rigid elastic shafts that project away from the toe cap 113. The plurality of bristles 131 can be intended for several uses including, but not limited to, scraping away any accumulated detritus 145 or buffing the target surface 142 to in order to polish the target surface 142. The stiffness of each of the plurality of bristles 131 will vary according to the intended use. A stiffer bristle will be more suitable for the removal of detritus 145 while a softer bristle will be more suitable for buffing the target surface 142. The stiffness of any first bristle selected from the plurality of bristles 131 compared to any second bristle selected from the bristles remaining in the plurality of bristles 131 can, but is not required to, vary.

The sole 111 is further defined with an insole 121 and an outsole 122. The foot 141 is in contact with the insole 121. The outsole 122 comprises a plurality of ports 123 and a plurality of plugs 124. Each of the plurality of ports 123 is a cylindrical cavity that is formed into the sole 111 through the outsole 122 such that an enclosed space is formed within the sole 111. As shown most clearly in FIG. 2, each of the plurality of plugs 124 is structure that is formed in the shape of a truncated cone. Each of the plurality of plugs 124 is formed from an elastomeric material.

Each port selected from the plurality of ports 123 has associated with it a corresponding plug selected from the plurality of plugs 124. The corresponding plug for each selected port 171 is sized such that the corresponding plug can be inserted 175 into the selected port 171. Each of the plurality of plugs 124 is sized such that when a plug selected from the plurality of plugs 124 is inserted 175 into its corresponding port the selected plug 172 will be compressed by the interior surface 173 of the corresponding port. As the elastomeric material forming the selected plug 172 returns to its relaxed shape, a force 174 is created between the selected plug 172 and the interior surface 173 of the corresponding port that locks the selected plug 172 into position.

The invention 100 is adapted to use a wet wipe 144 as a cleaning product selected from the one or more cleaning products 143. The wet wipe 144 is a readily and commercially available sheet of material that is generally used for wiping the target surface 142 to clean them. In the first potential embodiment of the disclosure, as shown most clearly in FIG. 6, the wet wipe 144 is attached to the outsole 122 by laying the wet wipe 144 flat against the outsole 122 and then inserting 175 each of the plurality of plugs 124 into the corresponding port selected from the plurality of ports 123 such that a portion of the wet wipe 144 is inserted 175 into each of the plurality of ports 123. The wet wipe 144 is held in position by the force 174 created between the selected plug 172 and the corresponding port.

The invention 100 is further adapted to use a commercially available cleaning solution as a cleaning product selected from the one or more cleaning products 143. In this scenario, the plurality of bristles 131 are wetted by dipping the plurality of bristles 131 into a container containing the cleaning solution before the plurality of bristles 131 are used to scrape or buff the target surface 142.

In the first potential embodiment of the disclosure, the each of the plurality of shoes 101 is formed as a single unit from molded plastic. Each of the plurality of plugs 124 is molded from polyurethane. The plurality of shoes 101 comprises a left shoe 151 and a right shoe 152. The plurality of ports 123 comprises 4 ports. The plurality of plugs 124 comprises 4 plugs.

The one or more straps 112 comprises a first strap 161 and a second strap 162. The invention 100 may include a cross-strap 177. The cross-strap 177 extends from the first strap 161 to the second strap 162. The cross-strap 177 is perpendicular with respect to the first strap 161 and the second strap 162.

The following definitions were used in this disclosure:

Bristle: As used in this disclosure, a bristle is a short coarse stiff hair or hair like object.

Buff: As used in this disclosure, to buff is a verb that means to polish a surface or structure by rubbing it with a soft object.

Cone: As used in this disclosure, a cone is a surface that is generated by rotating a triangle around one of the legs of the triangle. If a line that is perpendicular to the base that is drawn from the center of the base goes through the vertex of the triangle then the cone is called a right cone. A cone is a type of quadric surface. The cone is a pyramid with a circular base.

Correspond: As used in this disclosure, the term correspond means that a first object is in some manner linked to a second object in a one to one fashion.

Cylinder: As used in this disclosure, a cylinder is a geometric structure defined by two identical flat and parallel ends, also commonly referred to as bases, which are circular in shape and connected with a single curved surface, referred to in this disclosure as the face. The cross section of the cylinder remains the same from one end to another. The axis of the cylinder is formed by the straight line that connects the center of each of the two identical flat and parallel ends of the cylinder. In this disclosure, the term cylinder specifically means a right cylinder, which is defined as a cylinder wherein the curved surface perpendicularly intersects with the two identical flat and parallel ends.

Detritus: As used in this disclosure, detritus refers to dirt, plaque, calculus, stains or other accretions that accumulates on a surface.

Elastic: As used in this disclosure, an elastic is a material or object that deforms when a force is applied to it and that is able to return to its original shape after the force is removed. A material that exhibits these qualities is also referred to as an elastomeric material.

Exterior: As used in this disclosure, the exterior is use as a relational term that implies that an object is not contained within the boundary of a structure or a space.

Frustum: As used in this disclosure, a frustum is a portion of a solid that lies between two parallel planes that intersect with the solid.

Insole: As used in this disclosure, the insole is the surface of a shoe sole that is proximal to the wearer's foot.

Interior: As used in this disclosure, the interior is use as a relational term that implies that an object is contained within the boundary of a structure or a space.

Plug: As used in this disclosure, a plug is an object that is used as a barrier to block access to a cavity or an aperture.

Port: As used in this disclosure, a port is a cavity that is formed in an object that is adapted to receive a plug.

Outsole: As used in this disclosure, the outsole is the outer surface of the sole of the shoe that is in contact with the ground.

Relaxed Shape: As used in this disclosure, a structure is considered to be in its relaxed state when no shear, strain, or torsional forces are being applied to the structure.

Semi-Rigid Structure: As used in this disclosure, a semi-rigid structure is a solid structure that is stiff but not wholly inflexible and that will deform under force before breaking. A semi-rigid structure may or may not behave in an elastic fashion in that a semi-rigid structure need not return to a relaxed shape.

Shell: As used in this disclosure, a shell is a structure that forms an outer covering intended to contain an object. Shells are often, but not necessarily, rigid structures that are intended to protect the object contained within it.

Sole: As used in this disclosure, the sole component of a shoe that forms the undersurface of the shoe and comes in contact with the ground.

Strap: As used in this disclosure a strap is a strip of leather, cloth, or other flexible material that is used to fasten, secure, carry, or hold onto something.

Stiff and Stiffness: As used in this disclosure, the terms stiff and stiffness are comparative terms that used to compare the relative rigidity of two objects. Specifically, if the same force is applied to both a first object and a second object, the object that deforms less is said to be stiffer or more stiff than the object that displayed greater deformation.

Strip: As used in this disclosure, the term describes a long and narrow object of uniform thickness that appears thin relative to the length of the object. Strips are often rectangular in shape.

Truncated Cone: As used in this disclosure, a truncated cone is a frustum that remains when the apex of a cone is truncated by a plane that is parallel to the base of the cone.

Upper: As used in this disclosure, the upper is the portion of the shoe that is above the sole.

Wet Wipe: As used in this disclosure, a wet wipe is a paper or textile is that previously moistened and that is used for cleaning purposes. By previously moistened is meant that the paper or textile is moistened before the wet wipe is packaged for storage. These previously moistened papers or textiles will remain moist until subsequent accessed. The previously moistened paper or textile can be individually wrapped for storage or can be stored in bulk.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A cleaning implement comprising:

a plurality of shoes;

wherein the cleaning implement is adapted for use with a foot;

wherein each of the plurality of shoes is worn on a foot;

wherein the cleaning implement is adapted for use in cleaning the target surface;

wherein each of the plurality of shoes is rubbed against a target surface;

wherein the cleaning implement cleans and disinfects the target surface by using the foot to rub the cleaning implement against the target surface that needs to be cleaned;

wherein the cleaning implement is further adapted for use with cleaning products;

wherein each individual shoe selected from the plurality of shoes comprises a sole, an upper, and a toe cap;

wherein the upper secures the sole to the foot;

wherein the upper further comprises the toe cap;

wherein the toe cap is a shell that is attached to sole to form the front upper of the individual shoe;

wherein the exterior of the toe cap further comprises a plurality of bristles;

wherein the plurality of bristles comprises a collection of semi-rigid elastic shafts;

wherein each of the plurality of bristles project away from the toe cap;

wherein the sole is further defined with an insole and an outsole;

wherein the foot is in contact with the insole;

wherein the outsole comprises a plurality of ports and a plurality of plugs;

wherein each of the plurality of ports is a cylindrical cavity that is formed into the sole through the outsole such that an enclosed space is formed within the sole;

wherein each of the plurality of plugs is structure that is formed in the shape of a truncated cone.

2. The cleaning implement according to claim 1 wherein each of the plurality of plugs is formed from an elastomeric material.

3. The cleaning implement according to claim 2 wherein each port selected from the plurality of ports has associated with it a corresponding plug selected from the plurality of plugs.

4. The cleaning implement according to claim 3 wherein the corresponding plug for each selected port is sized such that the corresponding plug can be inserted into the selected port.

5. The cleaning implement according to claim 4 wherein each of the plurality of plugs is sized such that when a plug selected from the plurality of plugs is inserted into its corresponding port the selected plug will be compressed by the interior surface of the corresponding port.

6. The cleaning implement according to claim 5 wherein the one or more cleaning products further comprises a pre-treated cleaning sheet.

7. The cleaning implement according to claim 6 wherein the pre-treated cleaning sheet is laid flat against the outsole;

wherein the pre-treated cleaning sheet is inserted into each of the plurality of ports by inserting each of the plurality of plugs into the corresponding port selected from the plurality of ports such that a portion of the pre-treated cleaning sheet is inserted into each of the plurality of ports.

8. The cleaning implement according to claim 7 wherein the stiffness of any first bristle selected from the plurality of bristles compared to a second bristle selected from the bristles remaining in the plurality of bristles is variable.

9. The cleaning implement according to claim 8 wherein the upper comprises one or more straps.

10. The cleaning implement according to claim 9 wherein the plurality of shoes comprises a left shoe and a right shoe;

wherein the plurality of ports comprises four ports;

wherein the plurality of plugs comprises four plugs.

11. The cleaning implement according to claim 7 wherein the stiffness of any first bristle selected from the plurality of bristles compared to any second bristle selected from the bristles remaining in the plurality of bristles is the same.

12. The cleaning implement according to claim 11 wherein the upper comprises one or more straps; wherein the one or more straps comprises a first strap and a second strap; wherein the cross-strap extends from the first strap to the second strap; wherein the cross-strap is perpendicular with respect to the first strap and the second strap.

13. The cleaning implement according to claim 12
wherein the plurality of shoes comprises a left shoe and a right shoe;
wherein the plurality of ports comprises four ports;
wherein the plurality of plugs comprises four plugs.

14. The cleaning implement according to claim 1
wherein each individual shoe selected from the plurality of shoes comprises a sole, an upper, and a toe cap;
wherein the upper secures the sole to the foot;
wherein the sole is further defined with an insole and an outsole;
wherein the foot is in contact with the insole;
wherein the outsole comprises a plurality of ports and a plurality of plugs;
wherein each of the plurality of ports is a cylindrical cavity that is formed into the sole through the outsole such that an enclosed space is formed within the sole;
wherein each of the plurality of plugs is structure that is formed in the shape of a truncated cone;
wherein each of the plurality of plugs is formed from an elastomeric material;
wherein each port selected from the plurality of ports has associated with it a corresponding plug selected from the plurality of plugs;
wherein the corresponding plug for each selected port is sized such that the corresponding plug can be inserted into the selected port;
wherein each of the plurality of plugs is sized such that when a plug selected from the plurality of plugs is inserted into its corresponding port the selected plug will be compressed by the interior surface of the corresponding port;
wherein the one or more cleaning products further comprises a pre-treated cleaning sheet;
wherein the pre-treated cleaning sheet is laid flat against the outsole;
wherein the pre-treated cleaning sheet is inserted into each of the plurality of ports by inserting each of the plurality of plugs into the corresponding port selected from the plurality of ports such that a portion of the pre-treated cleaning sheet is inserted into each of the plurality of ports.

15. The cleaning implement according to claim 14
wherein the upper further comprises the toe cap;
wherein the toe cap is a shell that is attached to sole to form the front upper of the individual shoe;
wherein the exterior of the toe cap further comprises a plurality of bristles;
wherein the plurality of bristles comprises a collection of semi-rigid elastic shafts;
wherein the stiffness of any first bristle selected from the plurality of bristles compared to a second bristle selected from the bristles remaining in the plurality of bristles is variable.

* * * * *